United States Patent [19]

Kitamura et al.

[11] Patent Number: 5,030,435

[45] **Date of Patent: * Jul. 9, 1991**

[54] PROCESS FOR PRODUCING CHOPPED STRAND OF CARBON FIBER

[75] Inventors: Tadanori Kitamura; Hiroaki Shono; Atsuki Kodama, all of Fukushima, Japan

[73] Assignees: Nitto Boseki Co., Ltd., Fukushima; Kawasaki Steel Corporation, Kobe, both of Japan

[ * ] Notice: The portion of the term of this patent subsequent to Aug. 8, 2006 has been disclaimed.

[21] Appl. No.: 494,952

[22] Filed: Mar. 15, 1990

Related U.S. Application Data

[63] Continuation of Ser. No. 164,419, Mar. 4, 1988, abandoned, which is a continuation of Ser. No. 925,928, Nov. 3, 1986, abandoned.

[30] Foreign Application Priority Data

Nov. 19, 1985 [JP] Japan ..... 60-259248

[51] Int. Cl.[5] ..... D01F 9/12

[52] U.S. Cl. ..... 423/447.4; 423/447.1; 423/447.2; 423/447.6; 264/29.2

[58] Field of Search ..... 423/447.1, 447.2, 447.4, 423/447.6; 264/29.2

[56] References Cited

U.S. PATENT DOCUMENTS

| | | | |
|---|---|---|---|
| 3,959,448 | 5/1976 | Fuller et al. | 423/447.6 |
| 4,016,247 | 4/1977 | Otani et al. | 423/447.4 |
| 4,064,207 | 12/1977 | DeCrescente et al. | 423/447.6 |
| 4,080,413 | 3/1978 | Layden et al. | 264/29.2 |
| 4,115,527 | 9/1978 | Otani et al. | 423/447.6 |
| 4,243,512 | 1/1981 | Seo | 423/447.1 |
| 4,317,809 | 3/1982 | Lewis et al. | 423/447.1 |
| 4,435,375 | 3/1984 | Tamura et al. | 423/447.3 |
| 4,472,265 | 9/1984 | Otani | 423/447.4 |
| 4,490,201 | 12/1984 | Leeds | 423/447.4 |
| 4,565,683 | 1/1986 | Yates et al. | 423/447.3 |
| 4,582,662 | 4/1986 | Koga et al. | 423/447.6 |
| 4,664,900 | 5/1987 | Miyazaki et al. | 423/447.3 |
| 4,762,652 | 8/1988 | Miyamori et al. | 423/447.7 |
| 4,855,122 | 8/1989 | Kitamura et al. | 423/447.4 |
| 4,880,881 | 11/1989 | Mirami | 523/456 |

FOREIGN PATENT DOCUMENTS

| | | | |
|---|---|---|---|
| 0149348 | 7/1985 | European Pat. Off. | 264/29.2 |
| 61-70016 | 4/1986 | Japan | 264/29.2 |
| 61-108724 | 5/1986 | Japan | 423/447.4 |

*Primary Examiner*—Robert Kunemund

*Attorney, Agent, or Firm*—Wegner, Cantor, Mueller & Player

[57] ABSTRACT

The present invention relates to a process for producing a carbon fiber chopped strand which comprises preparing a pitch fiber from petroleum pitch or coal pitch, cutting the pitch fiber to a predetermined desired length, heating the cut pitch fiber at a high density accumulation in the atmosphere of an oxidative gas to infusibilize the cut pitch fiber, and then carbonizing and graphitizing the infusibilized fiber in an inert atmosphere. According to the process of the invention, no fuzz are formed on the fiber and no uneven infusibilization takes place. Further, the pitch fiber chopped strand accumulation has a high bulk density and relieve exothermic excursion naturally, and therefore neither combustion nor sticking takes place even in an oxidative atmosphere. Accordingly, the production speed can be enhanced and the cost can be lowered to a great extent.

11 Claims, No Drawings

PROCESS FOR PRODUCING CHOPPED STRAND OF CARBON FIBER

This application is a continuation of U.S. application Ser. No. 07/164,419, filed Mar. 4, 1988, now abandoned, which is a continuation of Ser. No. 06/925,928, filed Nov. 3, 1986, now abandoned.

BACKGROUND OF THE INVENTION

1. Field of the Invention

PAN type carbon fibers and pitch type carbon fibers are in use mainly in the fields of the materials relating to space aircrafts, lubricating parts, cement-reinforcing material, and the like. If the cost of carbon fiber can be reduced in the future by the improvement in the production technique of carbon fiber, an advance into automobile-related materials will also be expectable.

It should be noted here that carbon filament or tow-like carbon fiber is cut into a certain length (for example, 1 to 25 mm) and the resulting chopped strand is put to use in most of the fields, except for the field of space aircraft -related materials.

Taking notice of this point, the present invention has been invented. Thus, the present invention relates to a process for easily producing an inexpensive carbon fiber chopped strand of high quality from pitch type carbon fiber difficult to handle which comprises cutting a pitch fiber to obtain a chopped strand just after spinning, followed by infusibilizing, carbonizing and graphitizing the chopped strand in a state of high density accumulation.

2. Brief Description of the Prior Art

Hitherto, carbon fiber chopped strands have been produced in the following manner:

1) General-purpose grade

An optically isotropic pitch is formed into a fiber by the use of a centrifugal spinning machine and the resulting fiber is formed into a tow either before infusibilization or after carbonization, after which the tow is cut. This type of chopped strand is used as cement-reinforcing material, electromagnetic shielding materials, etc.

2) High-performance grade (a) PAN type

A polyacrylonitrile type fiber is stretched in the step of infusibilization and then carbonized to obtain a high performance carbon fiber. Then it is cut into chopped carbon fiber having a length of about 3 to 6 mm. This type of chopped strand is used in FRTP and the like.

(b) Mesophase pitch

Optically anisotropic mesophase pitch is spun to obtain a pitch fiber. In the form of a continuous filament, it is infusibilized and carbonized to obtain a continuous carbon fiber of high performances. Subsequently, the fiber is cut into desired length.

If, in the production of carbon fiber from pitch, infusibilization and carbonization are carried out in the state of continuous filament bundle according to the prior technics, a number of troubles mentioned below arise and make it difficult to obtain a carbon fiber of high quality:

a) When a wound pitch fiber is continuously unwound and infused and carbonized, fuzz arise, occuring the breakage of fiber in the process of unwinding.

b) When a pitch fiber wound on bobbin is infused as it is, the extent of infusibilization can become uneven between the inner layers and the outer layers, particularly if the thickness of winding is great.

c) When a pitch fiber discharged from nozzle and fed with air sucker is "coil"-wise accumulated in a basket and then subjected to infusibilization and carbonization, a breakage of fiber can take place due to the air sucker.

The above-mentioned faults a) and c) are attributable to the extreme fragility of pitch fiber having as low a tensile strength as 1 kg/mm$^2$ or less.

Further, when a continuous filament bundle of pitch fiber is infusibilized, an exothermic excursion has to be controlled for the purpose of preventing sticking.

Today, this exothermic excursion is controlled either by carrying out the infusibilization while maintaining the accumulation density of pitch fiber bundle in the range not exceeding 0.05 g/cm$^3$ and forcibly blowing air to prevent an exothermic excursion or by carrying out the infusibilization at an extremely low infusibilization rate.

All these existing means for preventing an exothermic excursion decrease the productivity of carbon fiber and greatly affect its cost.

SUMMARY OF THE INVENTION

The present invention relates to a process for producing a chopped strand of carbon fiber from petroleum pitch or coal pitch which comprises spinning the pitch to obtain a pitch fiber, cutting the pitch fiber to a certain desired length, heating the cut fiber in an atmosphere of oxidative gas in the state of high density accumulation to infusibilize the cut fiber, and then carbonizing and/or graphitizing the infusibilized fiber in an inert atmosphere.

DETAILED DESCRIPTION OF THE INVENTION

The present invention is based on knowledges that pitch type carbon fiber is used in the state of a chopped strand in many cases and that pitch type carbon fiber is different from PAN type carbon fiber in that it can give a high-performance carbon fiber without stretching process. According to the present invention, an appropriate sizing agent, for example, a low-boiling solvent such as water and methanol or a sizing agent containing a solid lubricant such as molybdenum disulfide, tungsten disulfide, talc or graphite, is coated to pitch fiber just after the melt spinning process, bundling the fibers with a bundling roller, and then immediately cutting the bundle with a cutting apparatus into a length of 1 to 50 mm, preferably 1 to 25 mm, to obtain a chopped strand. It is difficult to cut the bundle into a length shorter than 1 mm, and such a fiber length is too short to embody the desired reinforcing effect. When the length of the chopped strand is longer than 50 mm, the chopped strand is the same to a continuous fiber so that an increase in fiber length gives no increase in reinforcing effect. When the length of the chopped strand is more than 50 mm, the high density accumulation state cannot be attained, and infusibilization is thereby hindered. The chopped strand of high density accumulation thus obtained is subsequently infusibilized and carbonized.

Owing to this procedure, the fiber can be prevented from contacting with objects during the period of producing carbon fiber. Further, owing to the high bulk density of carbon fiber, the merit of high accumulation density can be embodied even if the thickness of accumulated layer is small. Further, the exothermic excursion can sufficiently be controlled only in natural state. Thus, all the above-mentioned problems arising at the time of infusibilizing the continuous fiber bundle can be solved.

According to the invention, the isotropic pitch fiber bundle or mesophase pitch fiber bundle which has been melt-spun from a nozzle of 30 to 4,000 H is cut into a length of 1 to 25 mm to form chopped strands, and then the chopped strands are infusibilized in an oxidative atmosphere at an accumulation density of about 0.7 g/cm$^3$ or below. In case of isotropic fiber bundle, the infusibilization is carried out by elevating the temperature at a rate of 1.5° C./minute till it reaches 320° C. and thereafter maintaining this temperature for 0 to 15 minutes. In case of meshophase pitch fiber bundle, the infusibilization is carried out by elevating the temperature at a rate of 2 to 10° C./minute till it reaches 350° C. and thereafter maintaining this temperature for 0 to 15 minutes. Subsequently, the infusibilized fiber bundle is carbonized and/or graphitized in an inert atmosphere by initially elevating the temperature at a rate of 5° to 100° C./minute till it reaches 800° to 3,000° C. and thereafter maintaining this temperature for a period of 30 minutes or less. From the carbonized and/or graphitized chopped strand thus obtained, carbon fibers free from sticking and maintaining the form of strand can be obtained.

If performances of the carbon fiber thus obtained are examined by the measurement of d002 by X-ray analysis and the measurement of electrical resistance, it can be confirmed that the carbonized product of chopped strand is equal to a carbonized product of long fiber bundle in its quality.

The process of the invention is different from the prior infusibilizing and carbonizing processes practised in the state of continuous filament bundle in that the process of the invention enables to achieve the carbon fiber without forming fuzz nor uneven infusibilization and to obtain a carbon fiber chopped strand of high quality because fragile pitch fiber is cut into strand just after spinning and bundling and thereafter its infusibilization and carbonization are carried out.

Further, since a high bulk density can be given to the accumulation of pitch fiber chopped strand, thickness of the accumulation layer can be made lessened, which promotes ventilation of air and relieve exothermic excursion naturally and, as its result, accumulation of heat and combustion or sticking in the oxidative atmosphere can be prevented. Further, since the accumulation has so high a bulk density as about 0.7 g/cm$^3$ which is about 10 times as high as the bulk density of continuous filament bundle in the prior infusibilization processes (0.05 g/cm$^3$), production speed can be elevated even if thickness of accumulation is somewhat smaller than in prior processes. Further, cost of production can greatly be lowered because relief of exothermic excursion can be controlled naturally.

Next, examples of the present invention will be mentioned. The examples presented herein are only for facilitating the understanding of the process of the invention and its effect and by no means for limiting the scope of the invention.

EXAMPLE 1

An isotropic pitch containing 58% by weight of benzene-insoluble fraction(BI) and containing no mesophase was formed into fiber with a spinning apparatus having a nozzle number of 1,000 to obtain a fiber having a fiber diameter of 13 $\mu$. After bundling the fiber with methanol, it was cut into a pitch fiber chopped strand having a length of 6 mm by means of a continuous cutting apparatus. At an accumulation density of 0.3 g/cm$^3$, it was heated in the presence of air at a temperature-elevating rate of 1.5° C./minute till its temperature reached 320° C. and thereafter maintained at this temperature for 5 minutes to make progress the infusibilization, after which it was heated in an atmosphere of nitrogen at a temperature-elevating rate of 20° C./minute till its temperature reached 1,000° C. and thereafter maintained at this temperature for 10 minutes to make progress the carbonization.

When the carbon fiber chopped strand thus obtained was thrown into an aqueous solution of a non-ionic surfactant, it was completely dispersed and disintegrated into filaments to demonstrate its entire freeness from sticking.

EXAMPLE 2

A mesophase pitch for spinning use containing 35% by weight of quinoline-insoluble fraction (QI) was formed into a fiber with a spinning apparatus having a nozzle number of 1,000 to obtain a pitch fiber having a fiber diameter of 13 $\mu$. After bundling the pitch fiber with a 10% dispersion of molybdenum disulfide, it was cut into strands having a length of 3 mm to obtain a pitch fiber chopped strand. At an accumulation density of 0.7 g/cm$^3$, it was heated in the presence of air at a temperature-elevating rate of 5° C./minute till its temperature reached 350° C. and thereafter maintained at this temperature for 5 minutes to make progress the infusibilization, after which it was heated in an atmosphere of nitrogen at a temperature-elevating rate of 50° C./minute till its temperature reached 1,000° C. and thereafter maintained at this temperature for 10 minutes to make progress the carbonization.

The carbon fiber chopped strand thus obtained was entirely free from sticking. X-ray analysis revealed that the spacing between the carbon layers of d002 was 3.65 to 3.7Å. Its electrical resistance was $2.35\times10^{-3}$ Ω.cm. These values were just equal to those of a product which had been carbonized in a state of continuous fiber bundle.

COMPARATIVE EXAMPLE

A pitch fiber prepared from the same pitch as used in Example 2 was accumulated into a basket by means of air sucker at an accumulation density of 0.05 g/cm$^3$. It was infused and carbonized in the state of continuous filament in the same manner as in Example 2, except that a forced air was carried out during the process of infusibilization.

The carbon fiber thus obtained had many fine fuzz. Further, since the continuous filaments were not well-arranged, it was impossible to take out the fiber from the basket and wind it on a bobbin.

What is claimed is:

1. A process for producing a carbon fiber chopped strand by using a petroleum pitch or coal pitch as starting material which comprises spinning the pitch to obtain a pitch fiber, coating the pitch fiber with a sizing agent selected from the group consisting of water containing a solid lubricant and methanol containing a solid lubricant, wherein the solid lubricant is molybdenum disulfide, tungsten disulfide, talc, or graphite, cutting the pitch fiber into a length of 1 to 50 mm, heating the chopped fiber at a high density accumulation in the atmosphere of an oxidative gas to infusibilize the chopped fiber, and then carbonizing and graphitizing the infusibilized fiber in an inert atmosphere.

2. A process according to claim 1, wherein the pitch fiber is cut into a length of 1 to 25 mm.

3. The process of claim 1 wherein the sizing agent is water containing a solid lubricant.

4. The process of claim 3 wherein the solid lubricant is molybdenum disulfide.

5. The process of claim 3 wherein the solid lubricant is tungsten disulfide.

6. The process of claim 3 wherein the solid lubricant is talc.

7. The process of claim 3 wherein the solid lubricant is graphite.

8. The process of claim 1 wherein the sizing agent is methanol containing a solid lubricant.

9. The process of claim 8 wherein the solid lubricant is tungsten disulfide.

10. The process of claim 8 wherein the solid lubricant is talc.

11. The process of claim 8 wherein the solid lubricant is graphite.

* * * * *